US007022095B2

(12) United States Patent
Schneider

(10) Patent No.: US 7,022,095 B2
(45) Date of Patent: Apr. 4, 2006

(54) SPORT BANDAGE

(76) Inventor: Michael Schneider, Fluraustrasse 59, Neuwied (DE) 56567

( * ) Notice: Subject to any disclaimer, the term of this patent is extended or adjusted under 35 U.S.C. 154(b) by 0 days.

(21) Appl. No.: 10/768,191

(22) Filed: Feb. 2, 2004

(65) Prior Publication Data

US 2005/0090773 A1 Apr. 28, 2005

(30) Foreign Application Priority Data

Feb. 1, 2003 (DE) ..... 203 01 530

(51) Int. Cl.
*A61F 13/00* (2006.01)

(52) U.S. Cl. ..... 602/64; 602/21

(58) Field of Classification Search ..... 602/19; 128/567–570, 7, 78; 2/44, 908; 450/121
See application file for complete search history.

(56) References Cited

U.S. PATENT DOCUMENTS 4,556,215 A * 12/1985 Tarbox et al. ..... 482/105
5,300,000 A * 4/1994 Schwartz ..... 482/105
6,592,537 B1 * 7/2003 Stager ..... 602/21

* cited by examiner

*Primary Examiner*—Henry Bennett
*Assistant Examiner*—Shumaya B. Ali
(74) *Attorney, Agent, or Firm*—Harbin King & Klima

(57) ABSTRACT

The invention relates to a sports brace comprising an elastic woven or knitted fabric, which for a sport of the kind that is performed using the arm or hand can be secured to the applicable arm or wrist (2) of the person using it by means of a closure (4).

Figure 1:
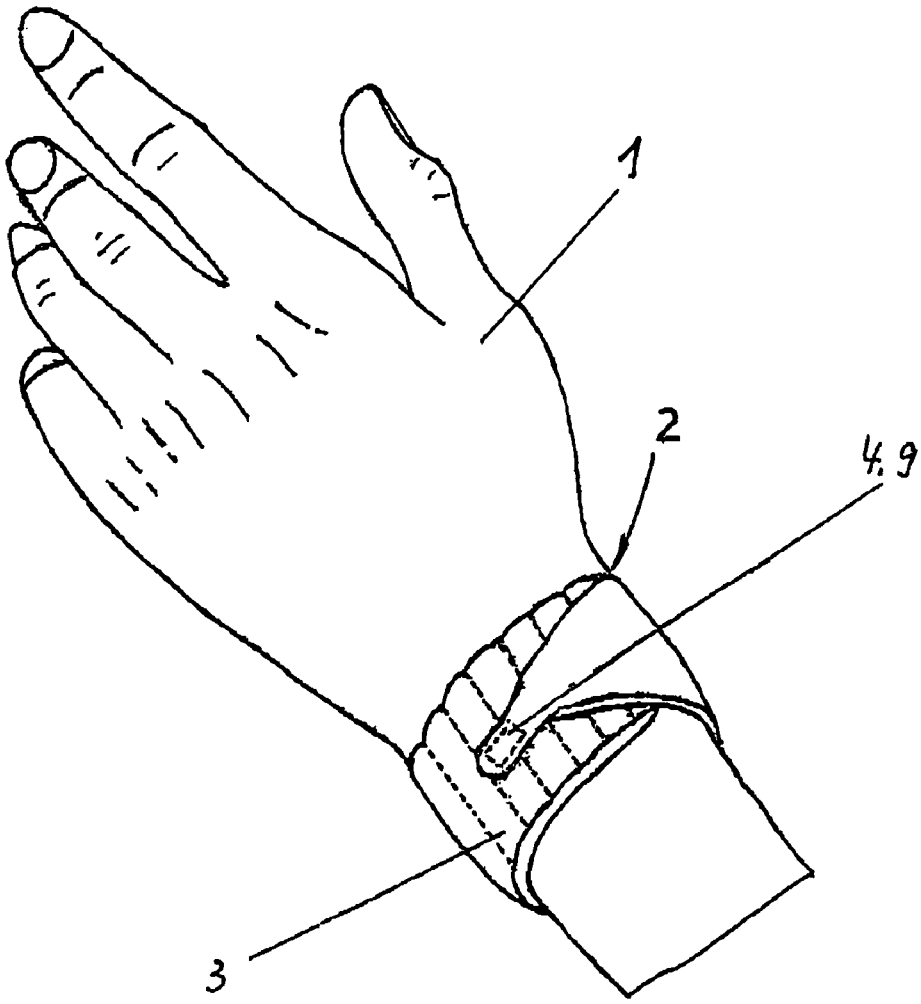

In order to provide that the sports brace (3) has better relief of the player's hitting hand or arm, compared to known braces, the invention proposes providing a plurality of weights (15), distributed over the surface, which act counter to the force of the ball hitting the racket used. To that end, the weights (15) or partial masses (18) of the weights (15) are movable within limits, so that their distribution over the brace also assures effectiveness at various impact angles of the ball or given a different posture of the hitting hand (1).

20 Claims, 3 Drawing Sheets

SPORT BANDAGE

The invention relates to a sports brace comprising an elastic woven or knitted fabric, which for a sport of the kind that is performed using the arm or hand can be secured to the applicable arm or wrist of the person using it by means of a closure.

In such sports as tennis, squash, badminton or table tennis, sports braces are intended to relieve (protect) the hand used for hitting; they comprise either an elastic bandage wound around the wrist, a leatherlike sheath which is secured around the wrist with the aid of leather straps and clasps, or a tubular sheath made from an elastic woven or knitted fabric.

These known sports braces are intended above all to limit the swivelling motion of the hand used for hitting relative to the adjoining forearm when a ball is hit, and so forth, and serve in particular to provide perfect guidance of the racket used. The loads on the hand and arm used for hitting that are generated by the ball when it is hit by the racket (for instance from the occurrence of mechanical oscillations), conversely, are reduced by such known sports braces to only a slight extent.

The object of the invention is to assure better relief of the player's hitting hand or arm, compared to known braces.

This object is attained according to the invention by the characteristics of claim 1. Further, especially advantageous features of the invention are disclosed by the dependent claims.

The invention is based essentially on the concept, in a sports brace comprising an elastic woven or knitted fabric, of providing a plurality of weights distributed over the surface, which counteract the force of the ball striking the racket. To that end, the weights or partial weights of the weights are disposed to be movable within limits, so that their distribution over the brace assures effectiveness at various impact angles of the ball or at a variable posture of the hitting hand.

It has proved expedient if the weights each include a housing, for instance of plastic, in which there are a plurality of freely movable spherical solid particles, preferably of metal, plastic or carbon. In practice, it has proved advantageous if each housing is approximately 50% to 75% filled with solid particles.

In one embodiment of the invention, the brace is two-ply and has a plurality of striplike chambers extending both parallel and transversely to the longitudinal axis of the brace, in each of which chambers a plurality of weights spaced apart from one another are disposed. The two plies of the brace each comprise an elastic material.

For producing such sports braces as quickly and simply as possible, it has proved advantageous if striplike substrates, for instance of plastic, are disposed in each of the striplike chambers, and the weights spaced apart from one another are secured to these striplike substrates. This is because with such an arrangement, the substrates can first be joined separately to the weights and the entire unit, comprising the respective substrates and weights, can be inserted into the corresponding chamber of the sports brace and sewn closed.

In order moreover to enable making a fast, secure connection of the weights with the substrates, it has proved expedient if the housings of the weights each have the form of a hemisphere and are joined by their flat side to the corresponding striplike substrate.

To make fast closing of the brace closure possible and to assure a secure hold of the closure in the ball game involved, the use of hook-and-loop closures has proved especially advantageous.

Figure 2:
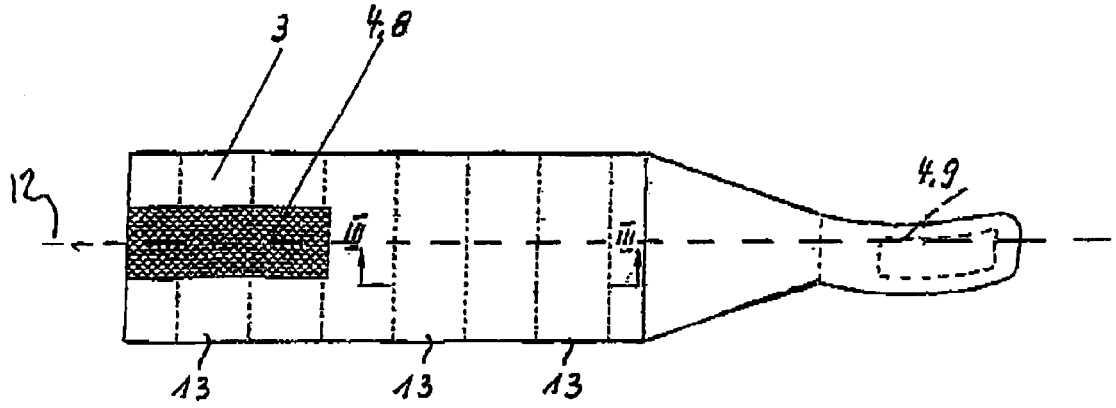
Figure 3:
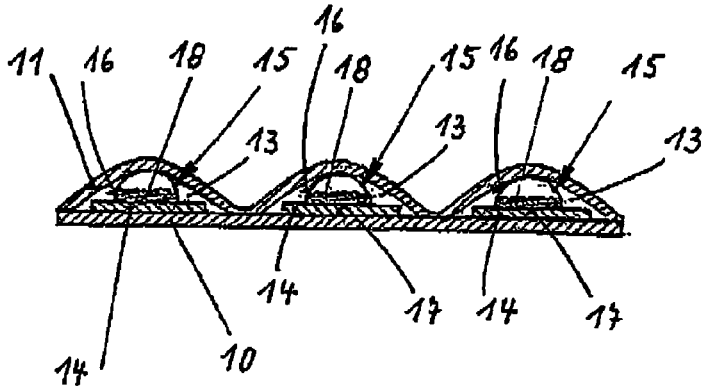
Figure 4:
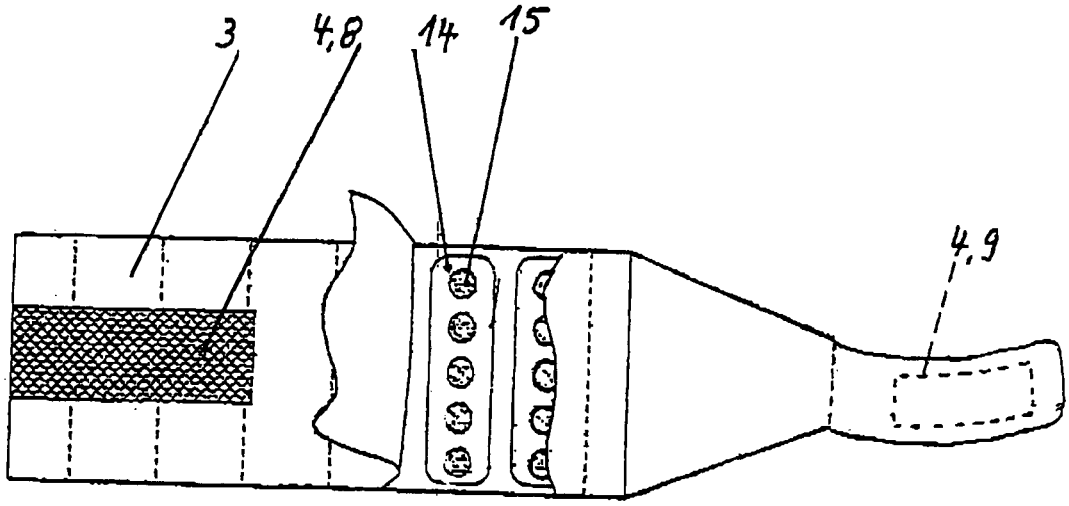
Figure 5:
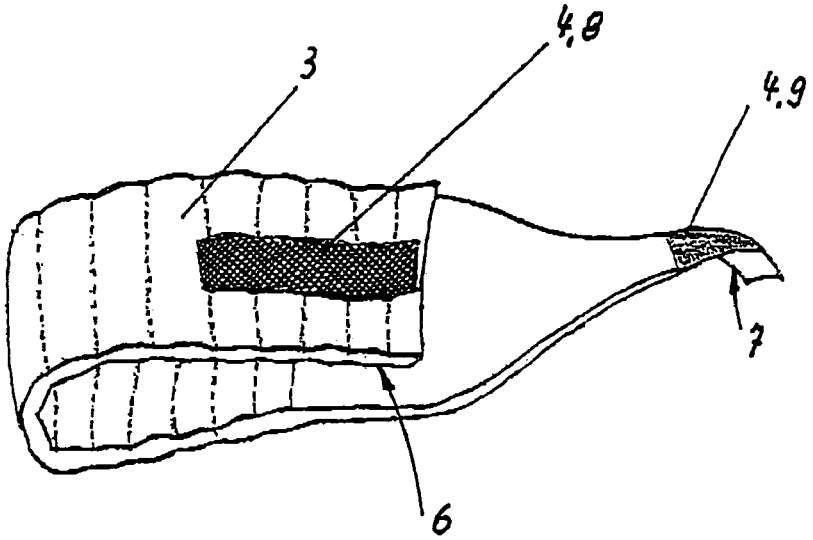

Further details and advantages of the invention will become apparent from the ensuing exemplary embodiments, described in conjunction with drawings. Shown are:

FIG. 1, a three-dimensional view of a sports brace of the invention, placed on the wrist of a player;

FIG. 2, the sports brace shown in FIG. 1, seen from outside in a developed view;

FIG. 3, a longitudinal section through a portion of the sports brace along the line marked III—III in FIG. 2;

FIG. 4, a view corresponding to FIG. 2, with the upper ply of the sports brace folded open in one region; and FIG. 5, a three-dimensional view of the sports brace shown in FIG. 1, in the open state.

In FIG. 1, reference numeral 1 indicates the hand of an player on whose wrist 2 a sports brace 3 of the invention is secured with a hook-and-loop closure 4. This hook-and-loop closure 4 can be seen for instance in FIG. 5 and comprises two closure regions 8, 9, disposed on the outside and inside on the respective ends 6, 7.

The sports brace 3 of the invention comprises two plies 10, 11 (FIG. 3) of an elastic woven fabric. A plurality of striplike chambers 13 extending to the longitudinal axis 12 of the brace 3 are formed by stitching. Plastic striplike substrates 14, which are each solidly joined (for instance glued) to five weights 15 (FIG. 4) are let into these chambers 13.

Each of the weights 15 comprises a housing 16, which is in the shape of a hemisphere and is joined by its flat side 17 to the substrate 14 (FIG. 3). Inside each housing 16, there are freely movable spherical solid particles 18 of metal.

To assure good mobility of the solid particles 18, no more than 50% to 75% of the volume of each housing 16 of the weights 15 should be filled with solid particles 18.

It is understood that the invention is not limited to the exemplary embodiment described above. For instance, the solid particles 18 need not necessarily be metal particles; depending on the type of sport and the type of racket, plastic particles or carbon fibers may be used as the partial weights of the weights. Moreover, the housings of the weights can also be embodied as complete spheres and can each be disposed in a single, for instance square, chamber of the brace.

It is understood that a closure provided with tapes or clasps may be used as the closure.

LIST OF REFERENCE NUMERALS

1 Hand
2 Wrist
3 Sports brace, brace
4 Hook-and-loop closure, closure
6, 7 Ends
8, 9 Closure regions
10, 11 Plies
12 Longitudinal axis
13 (Striplike) chamber
14 Substrate
15 Weights
16 Housing
17 Flat side
18 Solid particles, partial weights

What is claimed is:

1. A sports brace comprising an elastic woven or knitted fabric, which for a sport of the kind that is performed using the arm/hand can be secured to the applicable arm/wrist of the person using it by means of a closure, wherein the brace includes a plurality of distributed weights, each comprising one housing in which a plurality of freely movable solid particles are located, the solid particles of each weight being movable within the respective housing to counteract an impacting force on the hand/arm, the brace including a plurality of striplike chambers, in each of which a plurality of weights are disposed.

2. The sports brace of claim 1, wherein the brace is embodied in two-ply form with spacing between the plies forming the striplike chambers which extend both parallel and transversely to a longitudinal axis of the brace, and in which chambers, the disposed plurality of weights are spaced apart from one another.

3. The sports brace of claim 2, wherein in each of the striplike chambers, one striplike substrate is disposed, to which the weights spaced apart from one another are secured.

4. The sports brace of claim 3, wherein the housings of the weights each have the form of a hemisphere and are joined by their flat side to the corresponding striplike substrate.

5. The sports brace of claim 1, wherein at least one of the housings of the weights or the striplike substrates are made of plastic.

6. The sports brace of one of claim 1, wherein the solid particles of the weights are at least one of metal, plastic or carbon.

7. The sports brace of one of claim 1, wherein the solid particles of the weights each have a form that is generally spherical.

8. The sports brace of claim 1, wherein the respective housing of each of the weights is from 50% to 75% filled with solid particles.

9. The sports brace of claim 1, wherein a hook-and-loop closure is provided as the closure of the brace.

10. The sports brace of claim 2, wherein at least one of the housings of the weights or the striplike substrates are made of plastic.

11. The sports brace of claim 3, wherein at least one of the housings of the weights or the striplike substrates are made of plastic.

12. The sports brace of one of claim 4, characterized in that the housings (16) of the weights (15) and/or the striplike substrates (14) are of plastic.

13. The sports brace of claim 2, wherein the solid particles of the weights are at least one of metal, plastic or carbon.

14. The sports brace of claim 3, wherein the solid particles of the weights are at least one of metal, plastic or carbon.

15. The sports brace of claim 4, wherein the solid particles of the weights are at least one of metal, plastic or carbon.

16. The sports brace of claim 5, wherein the solid particles of the weights are at least one of metal, plastic or carbon.

17. The sports brace of claim 2, wherein the solid particles of the weights each have a form that is generally spherical.

18. The sports brace of claim 3, wherein the solid particles of the weights each have a form that is generally spherical.

19. The sports brace of claim 4, wherein the solid particles of the weights each have a form that is generally spherical.

20. The sports brace of claim 5, wherein the solid particles of the weights each have a form that is generally spherical.

* * * * *